United States Patent [19]

Hoshiro et al.

[11] Patent Number: 5,047,288

[45] Date of Patent: Sep. 10, 1991

[54] NONWOVEN FABRIC COMPRISING SINGLE FILAMENTS AND FILAMENT BUNDLES THAT YIELD IMPROVED IMPACT RESISTANT MOLDED ARTICLES

[75] Inventors: Hideki Hoshiro, Takatuki; Hironao Funabiki, Suita; Kenji Saimen, Okayama; Toshihide Ohigashi, Nara; Hiroshi Sugishima, Okayama, all of Japan

[73] Assignee: Kuraray Company Limited, Kurashiki, Japan

[21] Appl. No.: 501,868

[22] Filed: Mar. 28, 1990

[30] Foreign Application Priority Data

Mar. 31, 1989 [JP] Japan ..... 1-82112

[51] Int. Cl.[5] ..... B32B 27/04; D04H 1/00; D04H 3/00

[52] U.S. Cl. ..... 428/290; 428/288; 428/284; 428/303; 428/34.5; 428/902; 428/292; 428/232; 156/245; 162/149; 264/257; 264/258

[58] Field of Search ..... 428/303, 284, 288, 902, 428/290, 232, 34.5

[56] References Cited

U.S. PATENT DOCUMENTS 4,018,646 4/1977 Ruffo et al. ..... 428/303

4,656,081 4/1987 Ando et al. ..... 428/233

FOREIGN PATENT DOCUMENTS 0090397 10/1983 European Pat. Off. .

*Primary Examiner*—George Lesmes
*Assistant Examiner*—Richard C. Weisberger
*Attorney, Agent, or Firm*—Oblon, Spivak, McClelland, Maier & Neustadt

[57] ABSTRACT

Provided is a moldable sheet comprising a synthetic organic fiber nonwoven fabric for reinforcing resinous molded article and a resin composition having impregnated the nonwoven fabric. The nonwoven fabric comprises opened single filaments having a specific fineness and bundles of filaments laid parallel with one another having a specific total fineness distribution, said single filaments and said bundles of filaments being bonded with a binder of non-fiber form. By employing this construction, the nonwoven fabric can, when used for reinforcing resinous article, improve the impact resistance, i.e. falling ball impact resistance and Izod impact resistance, which have been poor with conventional glass-fiber reinforced resinous shaped articles, while maintaining the high mechanical strength of the resinous article.

4 Claims, No Drawings

NONWOVEN FABRIC COMPRISING SINGLE FILAMENTS AND FILAMENT BUNDLES THAT YIELD IMPROVED IMPACT RESISTANT MOLDED ARTICLES

BACKGROUND OF THE INVENTION

1. Field of the invention

The present invention relates to a nonwoven fabric comprising synthetic organic fiber, more specifically to such nonwoven fabric for reinforcement of resins which can give molded articles with excellent impact resistance, and also to moldable sheets comprising said nonwoven fabric impregnated with resin compositions.

2. Description of the prior art

Moldable sheets reinforced with reinforcing materials, represented by SMC (sheet molding compound), have been produced by a process which comprises:

consolidating a resin composition comprising unsaturated polyester resin and a filler, color, mold release, curing agent, thickener and the like, with short-cut chips of glass fiber roving yarn (known as "glass fiber strands") to form an endless sheet, covering both surfaces of the sheet With polyethylene film or the like, compressing the sheets to impregnate the resin composition into spaces between the glass fiber strands and to deaerate the sheet, and ageing the sheet at an appropriate temperature.

Glass fiber has generally been used for reinforcing resins, since it is excellent in mechanical properties such as fiber strength and rigidity, resistance to heat and dimensional stability, as well as in processability and the like.

The most serious drawback of resinous shaped articles reinforced with fiber (hereinafter referred to as FRP) in which glass fiber is used is inadequate impact resistance. If an FRP has a high impact strength, in particular high falling ball impact strength, the shaped article will, when given a shock, not readily generate cracks or whitening on its surface and thus maintain its high quality and neat appearance. While high falling ball impact resistance is therefore an indispensable requirement for shell plating of automobiles, railroad cars, ships, etc., as well as for pipes, bathtubs and the like, the use of glass fiber strands can never meet the requirement in practice. Accordingly, there has been strongly desired a technique that would bring a leap in improving falling ball impact strength in the field of FRP.

The present inventors had studied to improve the falling ball strength of FRP and found that the object can be achieved by:

(1) using organic fibers, particularly those having high strength and high elastic modulas, as reinforcement fiber, (2) dispersing the single filaments relatively uniformly, (3) using the organic fibers having large single-filament fineness, and (4) using the organic fibers in the form of nonwoven fabric.

The present inventors have further studied based on the findings (1) through (4) and completed the invention.

Japanese Patent Application Laid-open No. 42952/1988 discloses a nonwoven fabric used for reinforcing resins, which comprises non-glass-fiber staple fiber, the staple fiber being present as a mixture of one group of fiber opened into single filaments and the other group of fiber comprising unopened bundles comprising a plurality of single filaments laid parallel with one another, the two groups being bonded with each other. The patent application also describes that the nonwoven fabric having the above construction gives an FRP product, with a fiber content less than half that in the case where glass fiber chopped strand mat is used, having both high strength and high elastic modulus. However, the patent application does not define the combined state of opened single filaments and unopened strands (bundles). The tensile strength, flexural strength, impact strength and the like of an FRP product varies to a large extent depending on the fiber fineness, state of single filaments gathered and distribution of the gathered-filament bundles. Simple incorporation of opened single filaments and unopened bundles will therefore not always give a good FRP. Furthermore, the invention utilises an adhesive fiber for bonding the groups of fiber. Adhesive fiber must be incorporated in a large amount that can assure firm bonding, which however decreases the ratio incorporated of the reinforcing fiber, thereby decreasing reinforcement effect. The use of an adhesive fiber has another drawback in that the bonds between single filaments and filament bundles, and between bundles themselves are, during formation of molded articles, difficult to release in practice, and that hence such FRP has poor fluidity for molding deep-drawn articles. The problem has also been solved by the present invention.

SUMMARY OF THE INVENTION

The present invention provides nonwoven fabrics comprising a synthetic organic fiber for reinforcement of resinous molded articles, comprising a multiplicity of synthetic organic filaments (A) having a fineness of 1 to 50 deniers and a length of 5 to 200 mm and a multiplicity of strands (B) comprising a plurality of said filaments laid parallel with each other, the ratio by weight of (A) to [(A) +(B)] being 0 to 50%, the ratio by weight of the total weight of strands (B') having a total fineness of not more than 300 deniers and (A) to [(A) (B)] being 20 to 80% and the ratio by weight of strands (B'') having a total fineness of 500 to 5,000 to [(A) (B)] being 5 to 20%, and said single filaments (A) and said strands (B) being bonded with one another with a non-fiber binder in an amount of 1 to 20% by weight based on the total weight of [(A) +(B)]; and also moldable sheets formed of said nonwoven fabric impregnated with a resin composition.

DETAILED DESCRIPTION OF THE INVENTION

The present inventors have studied, for the purpose of improving the falling ball impact resistant FRP, to find out optimum single-filament fineness of synthetic organic fibers for reinforcement, and, as a result, found that the single filament fineness is preferably 1 to 50 deniers, and more preferably 5 to 30 deniers. Thus, a larger fineness is preferred than with conventional glass fiber.

While glass fiber generally decreases its single filament strength and rigidity rapidly with increasing fineness of its single filaments, synthetic organic fibers do not largely decrease their performance with increasing fineness. Consequently, where synthetic organic fibers are used for reinforcing purpose, it is possible to, by increasing the fineness of their single filaments, increase the falling ball impact strength without deteriorating tensile or flexural strength of the obtained FRP.

As regards the ease of manufacturing SMC, synthetic organic fibers having a fineness of single filaments of less than 1 denier give paper-like nonwoven fabrics, which are difficult to impregnate with resin and of poor fluidity. On the other hand, a single filament fineness exceeding 50 deniers leads to FRP having a coarse surface.

It is most desirable for the improvement of falling ball impact strength of an FRP that there be uniformly dispersed or distributed in the FRP both single filaments having a fineness of 1 to 50 deniers and strands comprising a plurality of filaments, which have not so large total fineness. This is because an impact energy caused by an impact force applied on an FRP is absorbed by the breakage of single filaments uniformly dispersed in the FRP, and that the resin domain is hence not readily broken. It was then found that high falling ball impact strength is achieved by nonwoven fabrics comprising synthetic organic fibers which comprises opened filaments (A) having a single-filament fineness of 1 to 50 deniers and strands (B) comprising a plurality of the single filaments, when the ratio by weight of (A) to [(A) +(B)] is 0 to 50% and the ratio by weight of the total weight of strands (B') having a total fineness of not more than -300 deniers and (A) to [(A) +(B)] is 20 to 80%. However, in the case where a nonwoven fabric for reinforcing resins substantially comprises opened single filaments uniformly dispersed therein, the molded articles obtained therefrom are low in pull-out resistance of fiber. Then, the articles show, when subjected to an impact, low energy value absorbed by the time they break completely, i.e. low Izod impact strength, while they have high falling ball impact strength though. On the other hand, where a nonwoven fabric comprising, in a larger ratio, unopened strands comprising a plurality of filaments is used, the molded articles obtained, therefrom suffer, while showing improved Izod impact strength thanks to increased pull-out resistance of fiber, breakage in the resin domain when a force is applied thereto. The articles therefore fail to make full use of fiber performance, and their mechanical properties, such as falling ball impact strength and flexural strength, decrease. In consideration of the above facts, the present inventors have studied into the state of distribution of opened filaments and strands, which would satisfy both falling ball impact strength and Izod impact strength and provide sufficient mechanical properties, and found that, in addition to the conditions described above, the most preferred condition is that the ratio by weight of strands (B") having a total fineness of 500 to 5,000 to [(A) +(B)] be 5 to 20%.

The results of the present inventors' experiments show that: if strands (B") are present in an amount of less than 5% by weight based on the total weight of fiber, the Izod impact strength will not be significantly improved; and, on the other hand, if the strands (B") are contained in an amount exceeding 20% by weight of the total fiber, the obtained FRP will become poorer in mechanical properties as well as in surface appearance. The fineness of a strand which is divided midway of its length into substrands having smaller finenesses is herein expressed as the fineness of the original strands provided that the length of the divided portion is not more than 50% the original length. Where the length exceeds 50%, the finenesses of single filaments and/or strands after the division are taken.

There are no particular restrictions as to the process for the production of the nonwoven fabrics for reinforcing resins, insofar as the obtained fabrics satisfy the conditions defined in the present invention, of opened filaments and unopened strands, and of distribution of such opened filaments and such strands. Thus, there can be employed a process which comprises blending an appropriate amount each of the opened filaments and unopened strands described in the instant specification, and forming the blend into a nonwoven fabric; a process which comprises appropriately opening or splitting strands during preparation thereof into finer strands and single filaments, and forming the obtained blend of the opened filaments and finer strands into a nonwoven fabric, or like processes. It, however, is preferred, in consideration of manufacturing cost of the obtainable nonwoven fabric for reinforcing resins, to employ the process which comprises appropriately opening strands, and forming the obtained blend of the opened filaments and finer strands into a nonwoven fabric.

It is desirable that the strands used for producing the nonwoven fabric of the present invention have a total fineness ranging from 500 to 5,000 deniers, more preferably 700 to 3,000 deniers. If the total fineness is less than 500 deniers, the strands will, during production of nonwoven fabric, be dispersed and opened substantially into single filaments, and hence do not produce the sufficient effect that only strand-formed fiber can provide On the other hand, if strands with the total fineness exceeding 5,000 deniers are used, the obtained nonwoven fabric will contain a plurality of significantly voluminous strands, which deleteriously affect the performance and surface appearance of the obtained FRP.

Glass fiber now used for SMC is generally at first in the form of glass fiber roving yarn having a total fineness of 500 to 700 deniers, which is cut with a roving cutter and the cut chops are immediately thereafter submitted to SMC production process. The SMC therefore incorporates the chopped strands which have not been opened so well and are not distributed in a state as described in the instant specification, being comprised almost of strands having a total fineness ranging from 500 to 700 deniers.

The length of the opened filaments and the strands of the synthetic organic fiber used in the invention is, while depending on the fineness of the single filaments, preferably 5 to 200 mm, and more preferably 10 to 100 mm. With the fiber length shorter than 5 mm the mechanical properties of the fiber is not fully utilized, while with the fiber length exceeding 200 mm the production of a nonwoven fabric from the fiber is extremely difficult.

The synthetic organic fiber constituting the nonwoven fabric of the present invention preferably has a singlefilament tensile strength and elastic modulus of 80 to 500 kg/mm$^2$ and 2500 to 25,000 kg/mm$^2$, respectively, in consideration of the performance of the obtained FRP. The synthetic organic fiber may be of roughened surface or irregular cross section for the purpose of enhancing the adhesiveness between the fiber and the resin to be impregnated.

Examples of the synthetic organic fiber are polyvinyl alcohol fiber, polyacrylonitrile fiber, polyamide fibers, polyester fibers, aramide fibers, polyallylate fibers, and the like, among which particularly preferred for end-uses requiring high tensile strength, elastic modulus, impact strength and the like of the obtained FRP are polyvinyl alcohol fiber, aramide fiber and polyallylate fiber. As required by the intended end-use, these synthetic organic fibers can be used in combination with one or more fibers other than synthetic organic fibers, such as glass fiber, carbon fiber, boron fiber and silicon carbide fiber.

Examples of the adhesive resin used for sizing the strands are polyvinyl acetate resin, polyester resins, polystyrene resin, polyurethane resins, melamine resins, epoxy resins, vinyl ester resins, unsaturated polyester resin, acrylic resins, polyamide resins, phenol resins and the like; and they are used preferably in an amount of 0.1 to 20% by weight based on the weight of fiber. The adhesive resin may, for increasing the adhesiveness with the synthetic organic fiber, incorporate a cocatalyst, silanecoupling agent, penetrating agent for resin, and the like in appropriate amounts.

The binder used for bonding the strands and opened filaments with one another to form a mat must be of nonfiber form. It has been found that what is known as "binder fiber", such as readily fusible polyester fiber and polyolefin fibers which are used while being uniformly blended with the reinforcing fiber, are not suited for use in the present invention from the following reasons:

(1) The use of a binder fiber gives, because of the fineness of the fiber being 2 to 5 deniers and its crimping, a bulky nonwoven, which can then not give an FRP with high fiber content.

(2) Since binder fibers are of poor adhesion efficiency, they must be added in a large amount to acquire sufficient adhesion, thereby decreasing the reinforcement effect of the synthetic organic fiber.

(3) The use of binder fibers make it difficult to release the bonds between the strands and/or single filaments of the reinforcement fiber used, and hence, when deep drawn articles are formed, to disperse the fiber into the ends of the shaped articles Accordingly, the binder for the production of the nonwoven or mat of the present invention, comprising unsaturated polyester resins, polyvinyl acetate resin, polyester resins, polystyrene resin, polyurethane resins, melamine resins, epoxy resins or the like is used in the form of solution, emulsion, suspension, powder or the like. It is also possible that the above binder resins be previously formed by melt blowing or like processes into a thin nonwoven fabric comprising ultrafine fiber, and then patching the thus prepared thin nonwoven fabric onto a mat of strands and/or single filaments. It has been found that the thin melt blown or like fabrics with ultrafine fiber eliminates the drawbacks attendant upon the use of thermofusible binder fibers. In the case where a matrix of an unsaturated polyester resin is used for the production of SMC, since the crosslinking agent for the unsaturated polyester is styrene, the binder resin used is preferably soluble in styrene, examples being polyvinyl acetate resin, polyester resins, polystyrene resin and unsaturated polyester resins. The binder resin is applied in an amount of 1 to 20% by weight. In the production of SMC of the present invention, the nonwoven fabric used assures a processability as a twodimensional fabric and, after formation of an SMC sheet, the binder resin used in the nonwoven fabric dissolves during ageing of the SMC, thereby causing the fiber strands and single filaments to readily become fluid and disperse in the course of producing molded articles. The binder resin for forming nonwoven fabric or mat may, wholly or partly, be provided by fusing again the adhesive resin having been applied for sizing the strands.

The nonwoven fabrics of the present invention can be used, besides for SMC, in various conventional processes for producing FRP, such as hand layup process, matched dye process, resin injection process and resin transfer molding process, or for producing FRTP, such as stampable sheet preparation process. Examples of the resin used in these processes are thermosetting resins, such as unsaturated polyester resins, epoxy resins, phenol resins and melamine resins, as well as thermoplastic resins, such as polypropylene resin, polyethylene terephthalate resin, polybutylene terephthalate resin, polycarbonate resins, polyacetal resins, polyphenylene sulfide resin, polyamide resins and ABS resins.

Described next is a representative example for the production of the nonwoven fabrics of the present invention. A synthetic organic fiber having a single-filament fineness of 1 to 50 deniers is laid parallel into a strand having a total fineness of 500 to 5,000 deniers, and to the strand the above-mentioned adhesive is added in an amount of 0.1 to 20% by weight based on the weight of the fiber, preferably 0.3 to 10% by weight on the same basis. The obtained resinbonded roving yarn is cut to a length of 5 to 200 mm, and the cut chips (chopped strands) are partly opened by air blowing, through an opening machine, or like processes and spread over a conveyor. The fiber mat thus formed may if required be lightly needle-punched for easier processability. Then a binder resin is sprayed uniformly onto the mat, and the mat impregnated with the binder is heat pressed to bond single filaments and filament bundles with one another, to form a consolidated nonwoven fabric.

The nonwoven fabric thus obtained preferably has a weight of, though depending on the intended fiber addition to the FRP to produce, 20 to 1,000 g/m$^2$, more preferably 50 to 500 g/m$^2$. Further it is preferred that the nonwoven fabric have a thickness of 0.2 to 3.0 mm for better processability into FRP, and a density of 0.01 to 0.5 9/cm$^3$, The thickness of a nonwoven fabric herein is measured in accordance with JIS p8118.

Examples of the process for the production of moldable sheet and shaped articles therefrom, from the reinforcing nonwoven fabric obtained above are now described. One comprises using a conventional SMC manufacturing apparatus. The nonwoven fabric is continuously introduced into a resin composition comprising an unsaturated polyester resin incorporating a filler curing agent, thickener, color and the like, and, after being covered with polyethylene film or the like on its both surface, pressed to be impregnated with the resin composition. The nonwoven with the resin composition is deaerated and taken up to a roll having a prescribed length. The roll is aged at an appropriate temperature to give a moldable sheet. The moldable sheet thus obtained is, in the same manner as for conventional SMC, placed in a mold, and there molded by heat pressing to give a shaped article. Another example is a process which comprises placing the nonwoven in a mold, closing the mold and injecting the resin composition into the mold, to obtain a shaped article. Still another example is what is known as "bag molding", i.e. a process which comprises the resin composition and the nonwoven fabric in an open mold, and deaerating them by applying pressure from above using a swelling rubber-bag. Yet another example is a process which comprises slitting the nonwoven into a plurality of endless tapes, impregnating the tape with the resin composition, and forming the tape with the resin into a pipe by applying conventional filament winding process. Also available is a process which comprises placing the nonwoven fabric between a pair of polypropylene resin sheet, pressing the obtained structure to cause the resin to penetrate into the nonwoven fabric to obtain a stampable sheet, placing the sheet in a mold and heat pressing it to obtain a shaped article.

The nonwoven fabric for reinforcing resin obtainable according to the present invention can, when used for the production of FRP, be used singly or, as occasion demands, as a laminate with a conventional reinforcing glass fiber material, such as glass fiber strand mat, glass fiber woven fabric or glass fiber endless mat, or with knitted, woven or nonwoven fabric of carbon fiber, aramide fiber or the like.

The nonwoven fabric for reinforcing resin obtainable according to the present invention has the following features.

1) It gives FRP's having higher impact strength, in particular higher falling ball impact strength, than conventional FRP using glass fiber.
2) It gives FRP's light in weight, since synthetic organic fibers are of smaller density than that of glass fiber.
3) It is excellent in impregnation capability with resin and can be used in the same manner as conventional glass fiber mat. Applicable are conventional processes for producing FRP, such as hand layup, filament winding, matched dieing, resin injection and resin transfer molding, and also processes for producing FRTp, such as stampable sheet production.
4) It can be processed using conventional SMC production apparatus without any large additional investment, and gives moldable sheets which can, due to excellent fluidity of fiber, be used in the same manner as conventional SMC.

Other features of the invention will become apparent in the course of the following descriptions of exemplary embodiments which are given for illustration of the invention and are not intended to be limiting thereof

EXAMPLES

EXAMPLE 1

A polyvinyl alcohol fiber having a single-filament fineness, tensile strength and elastic modulus of 10 deniers, 270 kg/mm$^2$ and 7,000 kg/mm$^2$, respectively was formed into a bundled yarn having a fineness of 2,500 deniers by applying 1.0% by weight of a polyvinyl acetate resin (VINYSOL 2102, made by Daido Kasei Co., Ltd.), and the yarn was cut to chips having a length of 50 mm. The chips were opened to some extent through an opening machine and dropped randomly onto a net to form a dry-laid web. A polyester resin emulsion (VILONAL MD1200, made by Toyobo Co., Ltd.) was sprayed onto the web, and the web was dried to give a nonwoven fabric having a weight of 200 g/m$^2$. The amount of the polyester resin added to the web was 5% by weight based on the weight of the polyvinyl alcohol fiber. The nonwoven fabric thus obtained contained opened single filaments in an amount of 5% by weight based on the total weight of the fiber, opened single filaments and filament bundles having total finenesses not more than 300 deniers in a total amount of 35% by weight on the same basis, and filament bundles having total finenesses at least 500 deniers in an amount of 15% by weight on the same basis. The nonwoven fabric was introduced in a conventional SMC manufacturing apparatus, where the fabric was impregnated with an unsaturated polyester resin composition, and the fabric with the composition was sandwiched between a pair of polyethylene films, followed by the usual procedure to give an SMC. The SMC thus obtained was of the following composition. resin composition:

Unsaturated polyester (POLYMAL 6709, made by Takeda Chemical Industries, Ltd): 100 parts
Catalyst: benzoyl peroxide (PERBUTYL, made by Nippon Oil & Fats Co;l Ltd.): 1.5
Filler: calcium carbonate (S-lyte, made by Nitto Funka Co., Ltd.): 500
Thickener: magnesium oxide (KYOWAMAG 40F, made by Kyowa Kagaku Co., Ltd.): 1.5

The amount of the reinforcing nonwoven fabric was adjusted to 20% by volume based on the total volume.

Eight plies of the SMC obtained was laminated and molded in the usual way under conditions of 150° C. and 100 kg/cm$^2$ to give FRP's having a size of 15.cm ×15 cm ×5 mm thickness. The physical properties of the FRP are shown in Table 1.

In all of the Examples and Comparative Examples given hereinbelow, the manufacturing conditions of SMC and the manufacturing conditions of FRP utilizing the SMC are same as above and their descriptions are hence omitted.

EXAMPLE 2

A polyallylate fiber having a single-filament fineness, tensile strength and elastic modulus of 10 deniers, 350 kg/mm$^2$ and 8,800 kg/mm$^2$, respectively, was formed into a bundled yarn having a fineness of 1,800 deniers by applying 4.0% by weight of a polystyrene latex (NIPOL LX303, made by Nippon Zeon Co., Ltd.), and the yarn was cut to chips having a length of 50 mm. The chips were opened to some extent through an opening machine and dropped randomly onto a net to form a dry-laid web. The web was heat pressed with a hot roll at 150° C. under a pressure of 100 kg/cm$^2$ to give a nonwoven fabric having a weight of 200 g/m$^2$. The nonwoven fabric thus obtained contained opened single filaments in an amount of 5% by weight based on the total weight of the fiber, opened single filaments and filament bundles having total finenesses not more than 300 deniers in a total amount of 25% by weight on the same basis, and filament bundles having total finenesses at least 500 deniers in an amount of 10% by weight on the same basis.

EXAMPLE 3

The chips of polyallylate fiber obtained in Example 2 were charged in a fiber feeder and continuously air blown and dropped randomly onto a net to form a dry-laid web. A polyester resin emulsion (Vilonal MD1200, made by Toyobo Co., Ltd.) was sprayed onto the web in an amount of 7% by weight, and the web was dried to give a nonwoven fabric having a weight of 150 g/m$^2$. The nonwoven fabric thus obtained contained opened single filaments in an amount of 7% by weight based on the total weight of the fiber, opened single filaments and filament bundles having total finenesses not more than 300 deniers in a total amount of 75% by weight on the same basis, and filament bundles having total finenesses at least 500 deniers in an amount of 7% by weight on the same basis.

EXAMPLE 4

An aramide fiber having a single-filament fineness, tensile strength and elastic modulus of 1.5 deniers, 315 kg/mm$^2$ and 11,300 kg/mm$^2$, respectively, was formed into a bundled yarn having a fineness of 1,500 deniers by applying 1.0% by weight of a polyvinyl acetate resin (VINYSOL 2102, made by Daido Kasei Co., Ltd.), and the yarn was cut to chips having a length of 50 mm. Separately, the same aramide fiber was bundled, without application of resin, into a 1,500-denier yarn, and the yarn was cut to chips having a length of 50 mm. The chips of sized yarn and those of unsized yarn were fed in a ratio of 30/70 to an opening machine and dropped randomly onto a net to form a dry-laid web. An unsaturated polyester resin powder (CHEMITYLENE PEB13, made by Sanyo Chemical Industries, Ltd.) was added uniformly onto the web in an amount of 5% by weight, and the web with the resin powder was heat pressed using a hot roll at 150° C. and under a pressure of 80 kg/cm$^2$ to give a nonwoven fabric. The nonwoven fabric thus obtained contained opened single filaments in an amount of 40% by weight based on the total weight of the fiber, opened single filaments and filament bundles having total finenesses not more than 300 deniers in a total amount of 70% by weight on the same basis, and filament bundles having total finenesses at least 500 deniers in an amount of 15% by weight on the same basis.

EXAMPLE 5

The chips of polyvinyl alcohol fiber obtained in Example 1 were mixed with glass fiber chopped strands having a length of 50 mm obtained by cutting a glass fiber roving (RS240PA-549SS, made by Nitto Boseki Co., Ltd.) in a ratio of 70/30. Thereafter, the procedure of Example 1 was followed to obtain a nonwoven fabric.

COMPARATIVE EXAMPLE 1

The chips of polyvinyl alcohol fiber obtained in Example 1 was fed to a ball feeder, which is an apparatus for feeding at a prescribed rate with vibrating, and dropped therefrom uniformly and randomly onto a net to give a drylaid web. A polyester resin emulsion (VYLONAL MD1200, made by Toyobo Co., Ltd.) was, in the same manner as in Example 1, sprayed onto the web in an amount of 5% by weight based on the weight of the fiber, and the web with the emulsion was then dried to give a nonwoven fabric having a weight of 200 g/m$^2$. The obtained nonwoven contains, since the chips had not been opened, unopened bundles only, all having a total fineness of 2,500 deniers.

COMPARATIVE EXAMPLE 2

A polyvinyl alcohol fiber having a single-filament fineness, tensile strength and elastic modulus of 10 deniers, 230 kg/mm$^2$ and 6,440 kg/mm$^2$, respectively, was formed into a bundled yarn having a fineness of 400 deniers by applying 1.0% by weight of a polyvinyl acetate resin (VINYSOL 2102, made by Daido Kasei Co., Ltd.), and the yarn was cut to chips having a length of 50 mm. Thereafter the procedure of Comparative Example 1 was followed to obtain a nonwoven fabric. The obtained nonwoven contains, since the chips had not been opened, unopened bundles only, all having a total fineness of 400 deniers.

COMPARATIVE EXAMPLE 3

A polyvinyl alcohol fiber having a single-filament fineness, tensile strength and elastic modulus of 17 deniers, 270 kg/mm$^2$ and 7,000 kg/mm$^2$, respectively, was, without application of a sizing resin, cut to a length of 80 mm. The cut staple thus obtained was formed into a drylaid, needle-punched nonwoven, in the usual way.

The obtained nonwoven contains single filaments completely uniformly dispersed therein.

COMPARATIVE EXAMPLE 4

The same chips as obtained in Example 2 except that the bundle fineness is 1,000 deniers were, in the same manner as in Example 2, fed to an opening machine and dropped randomly onto a net to form a dry-laid web. The web was then, in the same manner as in Example 2, heat pressed using a hot roll at 150° C. and under a pressure of 100 kg/cm$^2$ to give a nonwoven fabric having a weight of 200 g/m$^2$.

The nonwoven fabric thus obtained contained opened single filaments in an amount of 8% by weight based on the total weight of the fiber, opened single filaments and filament bundles having total finenesses not more than 300 deniers in a total amount of 31% by weight on the same basis, and filament bundles having total finenesses at least 500 deniers in an amount of 4% by weight on the same basis.

COMPARATIVE EXAMPLE 5

The same chips as obtained in Example 2 except that the bundle fineness is 4,000 deniers were, in the same manner as in Example 2, fed to an opening machine and dropped randomly onto a net to form a dry-laid web. The web was then, in the same manner as in Example 2, heat pressed using a hot roll at 150° C. and under a pressure of 100 kg/cm$^2$ to give a nonwoven fabric having a weight of 180 g/m$^2$.

The nonwoven fabric thus obtained contained opened single filaments in an amount of 6% by weight based on the total weight of the fiber, opened single filaments and filament bundles having total finenesses not more than 300 deniers in a total amount of 19% by weight on the same basis, and filament bundles having total finenesses at least 500 deniers in an amount of 18% by weight on the same basis.

The physical properties of the shaped articles obtained by the use of the reinforcing nonwoven fabric obtained in the above-described Examples and Comparative Examples are summarized, together with the experiment conditions, in Table 1. Table 1 also shows the results of Reference Example 1, in which a commercial SMC (RIGOLAC MG-100, made by Showa High polymer Co., Ltd.) was laminated and formed into an FRP.

As apparent from the table, in all of Examples, while the flexural strengths are about the same as that of glass fiber-reinforced shaped article, the falling ball impact strengths and Izod impact strengths are far better than that of glass fiber-reinforced shaped article.

TABLE 1

| | Reinforcing material | Physical Properties of Various FRP's: Distribution of strands (wt %) A | A + B' (≦300 d) | B'' (≧500 d) | Physical Properties: Flexural strength (kg/cm²) LOP | MOR | falling ball impact strength (kg · cm) | Izod Impact strength (kg · cm/cm) |
|---|---|---|---|---|---|---|---|---|
| Ex. 1 | Polyvinyl alcohol fiber | 5 | 35 | 15 | 750 | 2500 | 150 | 75 |
| Ex. 2 | Polyallylate fiber | 5 | 25 | 10 | 700 | 1800 | 300 | 100 |
| Ex. 3 | Polyallylate fiber | 10 | 75 | 7 | 700 | 1500 | 350 | 60 |
| Ex. 4 | Aramide fiber | 40 | 70 | 15 | 800 | 1700 | 250 | 100 |
| Ex. 5 | Polyvinyl alcohol fiber | 5 | 30 | 10 | 880 | 2200 | 100 | 60 |
| Comp. Ex. 1 | Polyvinyl alcohol fiber | 0 | 0 | 100 | 600 | 1000 | 30 | 80 |
| Comp. Ex. 2 | Polyvinyl alcohol fiber | 0 | 0 | 0 | 700 | 2200 | 100 | 40 |
| Comp. Ex. 3 | Polyvinyl alcohol fiber | 100 | 0 | 0 | 750 | 2500 | 170 | 20 |
| Comp. Ex. 4 | Polyallylate fiber | 8 | 31 | 4 | 650 | 1300 | 300 | 60 |
| Comp. Ex. 5 | Polyallylate fiber | 6 | 19 | 18 | 600 | 1400 | 200 | 100 |
| Ref. Ex. 1 | Glass fiber | 5 | 10 | 75 | 900 | 1800 | 20 | 40 |

(1) "A", "B'" and "B''" shown in the column of "Distribution of Strands" mean the synthetic organic single filaments (A), strands thereof (B') having a total fineness of not more than 300 deniers, and strands thereof (B'') having a total fineness of at least 500 deniers defined in the claims of the present invention.
(2) Flexural strength was measured according to JIS K6911; LOP: strength at limit of proportionality MOP: strength at rupture
(3) Falling ball impact strength was measured according to JIS K7211-1976, specimen size 90 mm × 90 mm held at 4 points
(4) Izod impact strength (notched) was measured according to JIS K6911-1970.
(5) The distribution of strands of glass fiber in Reference Example 1 was observed after the specimen had been heated in an electric oven at 500° C. for 3 hours to completely burn off unsaturated polyester resin.

COMPARATIVE EXAMPLE 6

To the fiber ships having a total fineness of 2,500 deniers and cut length of 50 mm obtained in Example 1, was added 20% by weight of a crimped readily fusible composite fiber (SOFIT N710, made by Kuraray Co., Ltd.) having a single filament fineness of 2.5 deniers, and the mixture was blended uniformly. The blend was fed to an opening machine and then dropped randomly onto a net to form a dry-laid web. The web was heat pressed using a hot roll at 170° C. and under a pressure of 100 kg/cm² to give a nonwoven fabric. The nonwoven fabric obtained had a fineness distribution of opened single filament and bundles of filaments, which is about the same as that of Example 1. The nonwoven fabric was, in the same manner as in Example 1, processed into a moldable sheet and further into a shaped article. The physical properties of the shaped article obtained were as shown in the following table.

| Physical property of FRP: Flexural strength (kg/cm²) at limit of proportionality (LOP) | at rupture (MOR) | falling ball impact strength (kg · cm) | Izod impact strength (kg · cm/cm²) |
|---|---|---|---|
| 600 | 1900 | 110 | 55 |

As shown in the table, where a thermofusible fiber is used for consolidating a loose fiber web, since the fusible fiber, in general, is of poor adhesion efficiency, it must be added in large amount, whereby the content ratio of the reinforcing web in the obtained moldable sheet is decreased, resulting in the decrease in flexural strength and impact resistance of the finished FRP.

EXAMPLE 6

The polyvinyl alcohol fiber chips prepared in Example 1 were fed to an opening machine and dropped randomly onto a net to form a dry-laid web. Separately, a binder nonwoven having a weight of 10 g/m² and comprising microfine filaments having diameters ranging from 1 to 5μ was prepared by melt-blowing process from an unsaturated polyester resin powder (CHEMITYLENE PEB-13, made by Sanyo Chemical Industries, Ltd.). The melt-blown nonwoven fabric was laminated on the above dry-laid web and the laminate is pressed with a hot roll at 150° C. and under a pressure of 100 kg/cm² to form a nonwoven fabric. The nonwoven fabric thus obtained was processed into a shaped article using the same resin composition and the molding condition as used in Example 1.

The obtained shaped article were, as shown in the table below, excellent in flexural strength and, at the same time, in both falling ball impact strength and Izod impact strength.

| Physical property of FRP: Flexural strength (kg/cm²) at limit of proportionality (LOP) | at rupture (MOR) | falling ball impact strength (kg · cm) | Izod impact strength (kg · cm/cm²) |
|---|---|---|---|
| 740 | 2600 | 145 | 75 |

Obviously, numerous modifications and variations of the present invention are possible in light of the above teachings. It is therefore to be understood that within the scope of the appended claims, the invention may be practiced otherwise than as specifically described herein.

What is claimed is:

1. A nonwoven fabric comprising a synthetic organic fiber for reinforcement of resinous molded articles, comprising a multiplicity of synthetic organic filaments (A) having a fineness of 1 to 50 deniers and a length of 5 to 200 mm and a multiplicity of strands (B) comprising a plurality of said filaments laid parallel with each other, the ratio by weight of (A) to [(A)+(B)] being 0 to 50%, the ratio by weight of the total weight of strands (B') having a total fineness of not more than 300 deniers and (A) to [(A)+(B)] being 20 to 80% and the ratio by weight of strands (B'') having a total fineness ob 500 to 5,000 to [(A)+(B)] being 5 to 20%, and said single filaments (A) and said strands (B) being bonded with one another with a non-fiber binder in an amount of 1 to 20% by weight based on the total weight of [(A)+(B)], wherein said fiber has a single-filament strength of 80 to 500 kg/mm$^2$.

2. A nonwoven fabric according to claim 1, wherein said nonwoven fabric has a weight of 20 to 1,000 g/m$^2$ and a thickness of 0.2 to 3.0 mm.

3. A nonwoven fabric according to either claim 1 or claim 2, wherein said non-fiber binder is a resin soluble in styrene.

4. A moldable sheet for producing shaped resin articles reinforced with a synthetic organic fiber, being formed of a nonwoven fabric comprising a multiplicity of synthetic organic filaments (A) having a fineness of 1 to 50 deniers and a length of 5 to 200 mm and a multiplicity of strands (B) comprising a plurality of said filaments laid parallel with each other, the ratio by weight of (A) to [(A) +(B)] being 0 to 50%, the ratio by weight of the total weight of strands (B') having a total fineness of not more than 300 deniers and (A) to [(A) +(B)] being 20 to 80% and the ratio by weight of strands (B'') having a total fineness of 500 to 5,000 deniers to [(A) +(B)] being 5 to 20%, and said single filaments (A) and said strands (B) being bonded with one another with a non-fiber binder in an amount of 1 to 20% by weight based on the total weight of [(A) +(B)], and a resin composition having impregnated said nonwoven fabric.

* * * * *